US007810293B2

(12) United States Patent
Gibbar et al.

(10) Patent No.: US 7,810,293 B2
(45) Date of Patent: Oct. 12, 2010

(54) MULTIPLE LAYER POLYMER FOAM AND CONCRETE SYSTEM FOR FORMING CONCRETE WALLS, PANELS, FLOORS, AND DECKS

(76) Inventors: James H. Gibbar, 411 Mulberry La., Perryville, MO (US) 63775; Faye F. Gibbar, 411 Mulberry La., Perryville, MO (US) 63775

( * ) Notice: Subject to any disclaimer, the term of this patent is extended or adjusted under 35 U.S.C. 154(b) by 668 days.

(21) Appl. No.: 11/504,479

(22) Filed: Aug. 15, 2006

(65) Prior Publication Data

US 2008/0041004 A1 Feb. 21, 2008

(51) Int. Cl.
*E04C 1/00* (2006.01)

(52) U.S. Cl. ..... 52/309.7; 52/320; 52/322; 52/323; 52/415; 52/425; 52/432; 52/439; 52/442

(58) Field of Classification Search ..... 52/309.6, 52/309.7, 309.12, 783.1, 319, 320, 321, 322, 52/323, 324, 325, 328, 415, 419, 425, 432, 52/439, 442; 249/29, 30, 83, 102
See application file for complete search history.

(56) References Cited

U.S. PATENT DOCUMENTS 4,085,558 A * 4/1978 Albrecht ..... 52/451
4,164,831 A 8/1979 Messick et al.
4,206,267 A * 6/1980 Jungbluth ..... 428/623
4,348,845 A 9/1982 Iannarelli
4,393,635 A 7/1983 Long
5,381,635 A 1/1995 Sanger
5,398,470 A 3/1995 Ritter et al.
5,673,525 A 10/1997 Keith et al.
5,830,399 A 11/1998 Keith et al.
5,930,965 A 8/1999 Carver
6,018,918 A 2/2000 Long, Sr.
6,112,489 A 9/2000 Zweig
6,272,749 B1 8/2001 Boeshart
6,276,104 B1 8/2001 Long, Sr. et al.
6,612,083 B1 9/2003 Richards
6,817,150 B1 11/2004 Boeshart

* cited by examiner

*Primary Examiner*—Richard E Chilcot, Jr.
*Assistant Examiner*—Chi Q Nguyen
(74) *Attorney, Agent, or Firm*—Paul M Denk

(57) ABSTRACT

Multiple layers of polymer foam form structural concrete into a desired planar shape that retains a foam panel when flat or upright. The polymer foam has a planar shape and an exterior surface with multiple channels into the panel. The channels are generally wider at the bottom and narrower towards the top, preferably a trapezoidal shape. In use, the panel is placed flat within a forming frame, exterior surface upwards. Then concrete is poured upon the exterior surface and into the channels. The trapezoidal shape of the channel prevents removal of the panel from the concrete. The concrete panel can then be used flat or upright as specified for a construction project.

13 Claims, 11 Drawing Sheets

MULTIPLE LAYER POLYMER FOAM AND CONCRETE SYSTEM FOR FORMING CONCRETE WALLS, PANELS, FLOORS, AND DECKS

BACKGROUND OF THE INVENTION

This concrete forming system relates to forms and methods for forming concrete panels in general and more specifically to a foam panel made integral with the concrete placed adjacent upon it. A unique aspect of the concrete forming system is a shaped channel in the foam panel that grasps a concrete tee or web located therein. This follows, secondly, the preformed groove that the forming boards are inserted into to create the shape of the formed concrete panel. The present invention employs expanded polystyrene as a layer in the concrete panel construction that produces a cost effective insulation system for a building.

For years, concrete has seen use in construction activities of many kinds. Concrete arises from a mixture of cement, water, fine aggregate, coarse aggregate, and additives. The mixture proportions can vary resulting in a wide variety of concretes. Overall, concrete begins in a plastic state and conforms to its container, commonly called a form. Once cured, concrete has a strong resistance against compressive loads and with steel reinforcement, concrete can resist tensile loads.

The American Concrete Institute regulates concrete as a durable, age old, and fire resistant building material. The Institute described and explained flat casting of concrete panels and then tilting the panels upwards to make a wall. The Institute printed publication 551R-92 "Concrete Tilt Up Structure" that explained the current state of the art in tilt up panels. Tilt up is a construction technique of casting concrete panel elements in a horizontal position at the job site and then tilting and lifting the panels to their final position in a structure.

Further, the federal government through various agencies has emphasized energy savings in construction, which can be achieved through usage of the construction method of this invention. In 2004, the Berkeley National Laboratory issued a report about electrical demand response. This report stemmed from the power crises that afflicted California in the early part of this decade. The report indicated that utilities, businesses, and consumers could cooperate to adjust demand for electricity in response to fluctuations in the spot price for electricity. The utilities would send a signal through the power grid that automatically disconnects equipment and users of electricity until the price lowers. Businesses and consumers would be compensated for the interruption in electricity by lower rates. Previously in 1992, the National Energy Policy Act required improved energy efficiency in commercial buildings and by other electricity users. Addressing the electrical demand and energy efficiency issues, the present invention provides insulation integral with a building wall. The insulation value of a panel constructed as the present invention inherently lowers heating and cooling costs. The present invention improves the energy efficiency of buildings of many descriptions and lowers the demand for electricity, commonly used for heating and predominantly used for cooling. The present invention is suitable for all types of buildings.

Another significant advantage of utilizing the laminar structure for forming a concrete-foam tilt up panel, is that the foam insulation further functions as a control for acoustics, which makes the wall panels fabricated in the manner of this invention very useful in the construction, for example, of buildings that require resistance to the transmission of sound, such as movie theaters, business offices, and related structures. The foam insulation resists the transmission of sound through a wall whether the foam is used separately or integrated into a wall panel. When placed into a wall panel, the foam insulation increases the resistance to sound transmission as it allows a contractor to incorporate an air gap between the interior wall finish and the foam insulation.

The present art overcomes the limitations of the prior art. That is, in the art of the present invention, a polymer foam panel is placed at the bottom of a form and concrete attaches upon the panel. The present invention displaces upwards of 30% of the mass of an existing panel or tilt up panel, and thus reduces the weight of a panel. The lower weight of a panel lessens the shipping costs and erecting costs associated with a heavier traditional tilt up panel. The present invention results in a stronger concrete panel with a higher strength to weight ratio when compared to a traditional tilt up panel. The present invention offers greater strength in the different states of concrete as it is placed, poured, trapped, or wrapped around the reinforcing steel into the panel of the present invention. The cost efficiency is a very desirable attribute of this invention. The present invention brings together insulation, structural reinforcement or metal studs, and concrete to produce an energy efficient insulated tilt up panel system. The polymer foam panel retains its shape as it provides a form for concrete that cures into a structural shape that bears the loads applied to a wall. The polymer foam panel incorporated into a concrete panel provides insulation with a higher R value, and displaces concrete thus saving weight while maintaining strength.

The polymer foam panel shape includes grooves for metal studs that serve as an attachment mechanism for finishes and provides a void that functions as an electrical or plumbing chase. Additionally, this invention uses the polystyrene foam to support a truly unique method of supporting forming boards that create the final shape of the concrete panel. The only method of forming wall panels in today's tilt-up or pre-cast industries is to set up metal, wood or plastic forms that create the final shape of the wall panel. This invention incorporates a special groove near the edge of the foam panel that enables a form to be quickly inserted prior to casting the concrete and then quickly removed following adequate hydration of the concrete. The invention eliminates the need for costly steel bracing, expensive laminated forms and the unavoidable damage to concrete floors that serve as an attachment surface for forms and bracing. In addition to these benefits, the labor cost to set up and tear down forms is substantially reduced.

DESCRIPTION OF THE PRIOR ART

The difficulty in providing a polymer foam panel in a concrete forming system is shown by a typical tilt up panel. Prior art concrete panels call for a grid of reinforcing steel for structural integrity and to withstand loads against a panel, such as, generally wind load. Thus, a panel is made by constructing a form to the specified dimensions and thickness, then placing reinforcing steel within the form. The reinforcing steel is tied together and positioned according to the construction plans. Crews of steel workers position and tie the steel. Once the steel has been tied, concrete is placed into the form and worked around and over the steel. After curing, the forms are removed and the concrete panel is lifted into its final position.

However, prior art panel construction uses much reinforcing steel and the labor costs to install the steel are high. Full thickness concrete panels are heavy and require a crane to lift and position the panels. At hundreds of dollars per day, crane availability become expensive for installing heavy panels. The concrete in a panel provides structural support to a building but has limited insulative value. After installation, a concrete panel has to be insulated, generally upon the interior, at an additional cost in time and labor to a contractor. Presently, insulation is retro-fitted, as batts, rolls, boards, or upon furring, onto the interior faces of installed panels inside a building using another crew of workers. To attain some insulation value on the exterior, another crew of workers adheres rigid insulation board to the exterior of concrete panels and then a finishing crew applies stucco or other surface treatment. Adding insulation to installed panels, either on the interior or the exterior adds significantly to material and labor costs on a construction project.

Reviewing the prior art, the patents, U.S. Pat. Nos. 6,272,749 and 6,817,150, to Boeshart show foam panels used as concrete forms for decking. The decking can be factory or jobsite cast. The '749 patent discloses a foam panel, hat shaped, with a removable center portion bounded by C channels. The C channels have upright webs in the '749 patent. Then the '150 patent discloses a foam panel with two grooves and additional hat panels to alter the depth of the panel. The panel also has C channels positioned lengthwise in the foam similar to the present invention. The C channels are permanently bonded into the foam slab during the foam extrusion process. The extrusion process does not leave a void inside the channel but rather the foam completely encompasses three sides and the core of the stud. The Boeshart patents are used to make panels with reinforcing ribs or tees.

The patent to Messick, et al., U.S. Pat. No. 4,164,831, shows a heat insulating and sound absorbing concrete wall panel. This concrete wall can be manufactured at a site remote from its usage, transported to the point of installation, and then tilted up into position. Initially, this particular wall is formed of panels that are fabricated from concrete, generally as shown at its beamed portion, and formed integrally with the slab portion. The slab portion has a series of recesses, and subsequently into them are located the thermal insulation, the sound absorbing material, and the cover plate. Then, another layer of poured concrete is applied over the located insulation to form the final wall. Hence, this particular patent does show planar concrete above, beamed concrete below, and some segments of thermal, sound and other insulation provided interiorly of the wall itself.

The patent to Iannarelli, U.S. Pat. No. 4,348,845, shows a thermally insulated masonry block. These are just concrete blocks, with some type of a grout applied within their openings.

The patent to Long, U.S. Pat. No. 4,393,635, shows an insulated wall construction apparatus. The structured wall comprises a pair of outer poured concrete layers which are separated by a high density foam insulating panel. In addition, tie-rods or locking means extend between the various panels and foam. This certainly shows a wall, but apparently poured in place, having concrete interiorly and exteriorly, with foam insulation therebetween.

The patent to Sanger, U.S. Pat. No. 5,381,635, shows another construction wall panel and structure that includes a concrete planar portion, forming a first face, and having at least one concrete rib projecting from one of its faces. This rib is arranged between the foam blocks of polystyrene. This patent includes plastic studs that apparently extend out of the inner wall to receive drywall anchoring fasteners. The claims also call for a plastic sheet that is secured parallel to and spaced apart from the rib outer faces in its structure. The claims of this patent define the use of U-Shaped stud channels, for functioning as fastener receiving portions.

This prefabricated panel includes a concrete planar portion, forming a first face, and having at least one concrete rib projecting opposite the first face. Polystyrene blocks are located on either side of the rib. A stud channel joins to the bottom of the rib and drywall later attaches to the stud channel. In use, the '635 patent provides a form for casting a panel. The form has a wooden header and a steel, generally C channel, footer. The stud channel spans from the header to the footer. Polystyrene blocks are then placed adjacent to the stud channel. Concrete is then placed over and around the blocks, then vibrated into the recesses of the stud channel and the footer. Upon curing, the '635 patent provides a concrete panel that frames insulating blocks. The panel then interconnects with others to form a structure.

The '635 patent also shows the stud channel at the bottom of the rib. In the '635 patent, the stud channel is a C shaped channel with the web parallel to the first face of the concrete and the flanges parallel to the rib. The stud channel also has a sheet of insulation between the rib and the web of the stud channel. The stud channel has the outside of the web exposed and usable to attach drywall.

The patent to Ritter, et al., U.S. Pat. No. 5,398,470, shows a reinforcement body for a floor slab. This patent defines a reinforcement body for a cast concrete floor slab, which includes a variety of reinforcement rods, reinforcing and spacer wires, apparently which embed within the floor slab, and then has a displacement body, of foam, such as polystyrene, that is arranged within a formed slab. This is not necessarily the structure of the present invention, but nevertheless, does apparently show concrete above and below, reinforced, and having foam inside thereof.

The patent to Keith, et al., U.S. Pat. No. 5,673,525, shows insulating connector rods used in making highly insulated composite wall structures. This particular patent covers the connector rods, for anchoring an insulating layer between the concrete layers.

Another patent to Keith, et al., U.S. Pat. No. 5,830,399, shows a method for manufacturing highly insulated composite wall structures, having first and second structural layers, and an insulating layer disposed therebetween. Then, there is included use of a connector rod, which has a pointed tip at one end as a penetrating segment, and an enlarged head at the other end of the connector rod, apparently for embedding within the outer layer of the concrete.

The patent to Carver, U.S. Pat. No. 5,930,965, is upon an insulated deck structure, formed of concrete, but having a foam insulation member therein, and which apparently acts as a form, when the concrete is poured.

The patent to Long, Sr., U.S. Pat. No. 6,018,918, is upon a wall panel with vapor barriers. The wall structure form of this patent includes the use of particular channel members, applied with a vapor barrier. The wall structure includes first and second concrete layers, with an insulation layer arranged therebetween.

The patent to Zweig, U.S. Pat. No. 6,112,489, is upon a monocoque concrete structure having a core structure, comprised of foam panels, with layers of concrete on each of the opposite sides. It has a load bearing concrete shell on the opposite sides of the core structure. The core structure comprised of the foam panels is arranged within a framework for holding the frame panels in place, before the concrete is applied to their opposite surfaces.

The patent to Long, et al., U.S. Pat. No. 6,276,104, is upon extruded polystyrene foam insulation laminates for pour-in-place concrete walls. This wall is formed with a thermal insulation foam panel and then foam board placed to either side, all within forms, so that concrete then may be filled externally of these foam panels, to form their structured wall.

Finally, the patent to Richards, U.S. Pat. No. 6,612,083, shows another system of building construction. This particular system utilizes a plurality of coilies that span the width of the wall module, unlike the tie means of the present invention.

The present invention overcomes the difficulties of the prior art. The present invention has a polymer foam sheet placed inside a concrete form and then joined to concrete placed upon the panel forming multiple layers into a panel. The panel of the present invention is then installed into a building following conventional methods of construction.

SUMMARY OF THE INVENTION

The present invention is multiple layers of polymer foam for forming concrete into a desired planar shape or panel. The polymer foam has a planar shape and an exterior surface where multiple channels extend across the length of the panel and beneath the exterior surface into the panel. The channels have a cross section generally wider at the bottom and narrowing towards the exterior surface. In the preferred embodiment, the channels have a rectangular shape, and the alternative channel has a trapezoidal shape. In use, the panels are placed on a solid level surface with the exterior surface up. Lines are drawn on the foam panel for the location of the perimeter forms. Then a groove is cut into the foam approximately two inches deep more or less. The perimeter forms are inserted into the groove to create the concrete wall shape. Then the concrete is placed into the channels and upon the exterior surface of the panel in one continuous pour. Once the concrete is sufficiently hard the forms are removed and the excess foam is trimmed away before the panels are moved. An optional yet common practice is to place the panel flat within a forming frame, with the exterior surface up. Then concrete is placed upon the exterior surface and into the channels. Upon curing, the concrete bonds to the exterior surface and has webs that extend into the channels. The trapezoidal shape of a channel prevents removal of the foam panel from the concrete webs. Once the concrete has hardened, preferably cured twenty eight days, to the designed compressive strength, the foam panel will be bonded with the concrete and all its components, and then the panel is removed from its casting position and installed into the building structure as designed. The panel can then be used flat or upright as specified in the construction documents.

There has thus been outlined, rather broadly, the more important features of the invention in order that the detailed description thereof that follows may be better understood and that the present contribution to the art may be better appreciated.

Further, the present invention also includes reinforcing steel studs placed within the channels, as an attachment mechanism for finishes attached to the interior surface opposite the exterior surface, reinforcing members embedded within the concrete panel, lifting loops, metal ties, reinforced resin ties or plastic ties, brace inserts, weld plate inserts and openings through a finished panel.

Therefore, it is an object of the present invention to provide new and improved insulation capability to formed concrete panels.

It is an object of the present invention to reduce the load placed upon a building's heating and cooling, or HVAC, system. Reducing the load saves building owners on construction and operating costs, and frees floor space for leasing to tenants.

It is an object of the present invention to provide an incentive to building owners and architects to reduce electrical loads and consumption in commercial and all other category of building structures.

It is a further object of the present invention to lower the cost of concrete in a panel, to decrease construction time, and to accelerate erection of the structure of a building.

It is a still further object of the present invention to eliminate retro-fitting of insulation upon installed concrete panels.

It is an even still further object of the present invention to provide a panel readily cut and manipulated for utility chases or passageways.

It is an even still further object of the present invention to eliminate any cold spots or thermal conduction areas in a concrete panel.

It is an important object of the present invention to provide a panel that minimizes transmission of sound.

It is an even still further object of the present invention to provide a panel with a smooth interior surface for cleanliness and sanitation in a food or temperature controlled environment.

It is an even still further object of the present invention to reduce labor costs associated with forming and stripping of a panel.

It is an even still further object of the present invention to substantially reduce the cost of forming materials, since the integrated forming groove of this invention makes this savings possible.

It is a further object of this present invention to enable to owner to construct the insulated panel such that concrete is optional on both sides of the panel.

It is an even further object of this present invention to provide a means of attachment for all other finish systems that may be available without retrofitting the panel with other mechanical attachment systems or components as presently practiced.

These and other objects may become more apparent to those skilled in the art upon review of the invention as described herein, and upon undertaking a study of the description of its preferred embodiment, when viewed in conjunction with the drawings.

BRIEF DESCRIPTION OF THE DRAWINGS

FIG. 10 shows a detailed view of the further reinforced concrete panel laminated with polymer foam to form an extra strength wall, deck, or the like;

The same reference numerals refer to the same parts throughout the various figures.

DESCRIPTION OF THE PREFERRED EMBODIMENT

Figure 1:
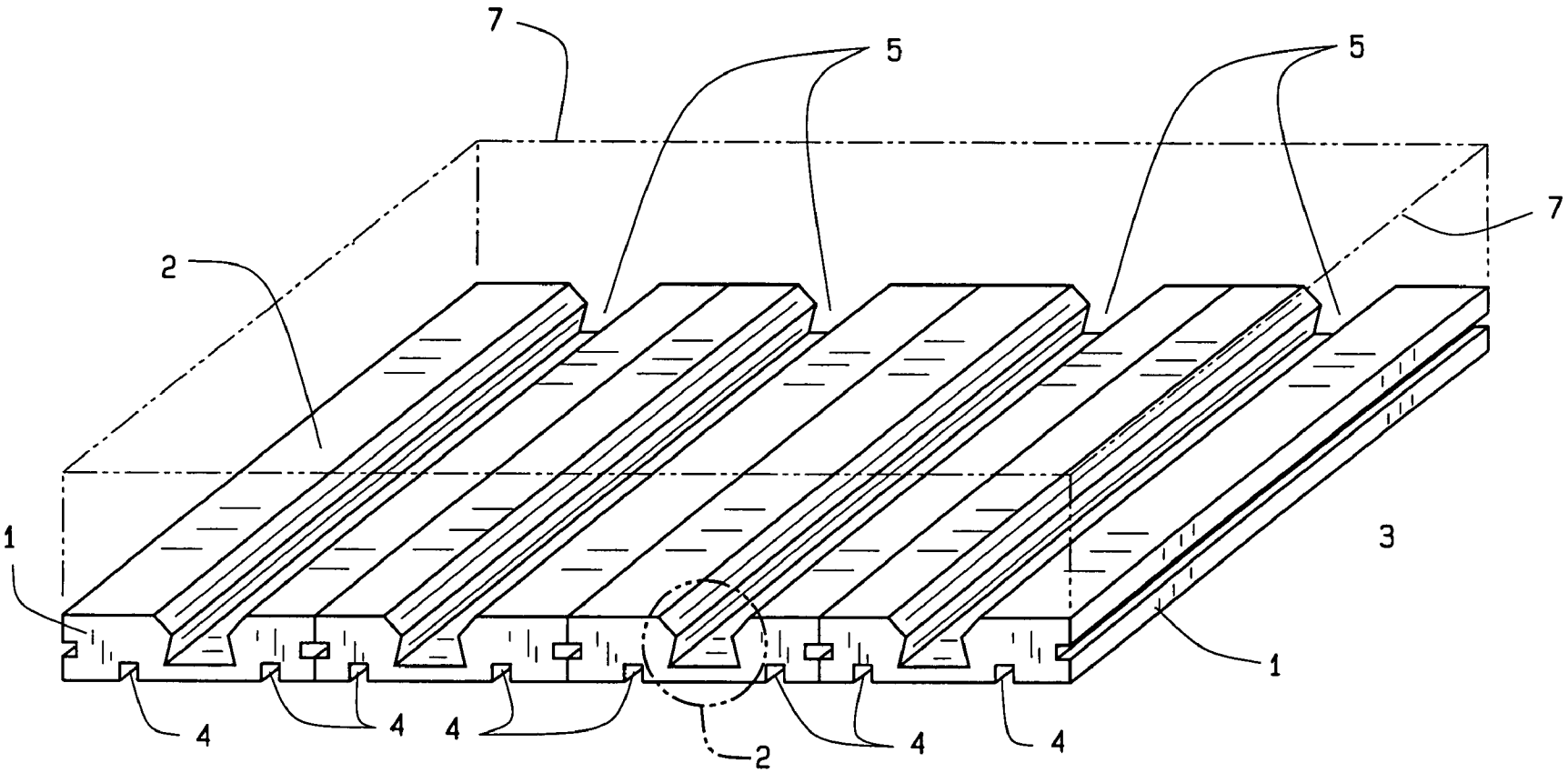
FIG. 1 shows an isometric view of the preferred embodiment of the present invention.

The present art overcomes the prior art limitations by providing multiple layers of polymer foam for forming concrete into a panel. Turning to FIG. 1, the present invention 1 appears as a panel of polymer foam, preferably polystyrene slab of one and a half pounds (1½ lb.), more or less, per square foot density expanded polystyrene insulation, commonly called EPS. The panel 1 has a rectangular shape with two mutually parallel and spaced apart longitudinal edges 1*a*, and two mutually parallel and spaced apart lateral edges 1*b*, perpendicular to the longitudinal edges. The panel has an exterior surface 2 shown here in FIG. 1. A lift of concrete 7 is placed upon the exterior surface 2 at an engineered thickness, here shown in phantom line.

Upon the exterior surface, the panel 1 has a plurality of channels 5 formed across the length of the panel. The channels 5 are parallel to the lateral edges of the panel and spaced apart at a regular interval. In the preferred embodiment, the panel has four channels 5 formed and spaced apart at approximately sixteen inches on center.

Figure 2:
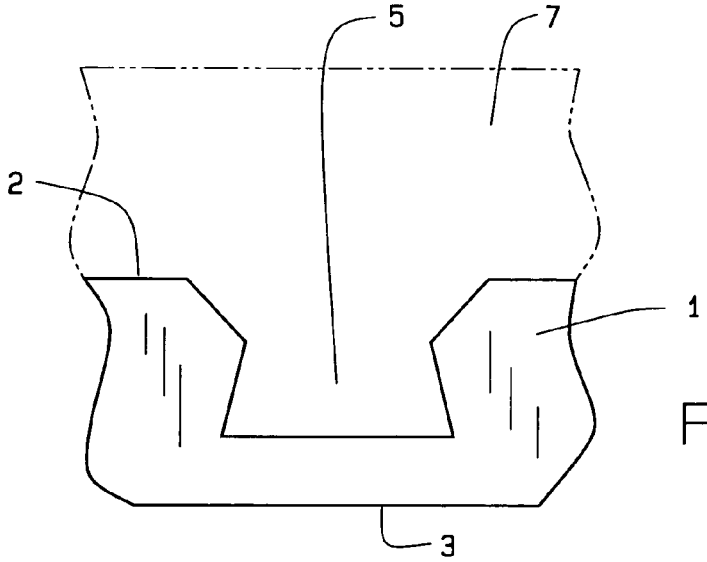
FIG. 2 shows a detailed view of a channel in the present invention.

Looking more closely, FIG. 2 shows a detailed view of a channel 5. The channel has sufficient depth to meet minimum ACI standards and to later accommodate reinforcing steel or rebars 6. The channel begins at the exterior surface 2 of the panel 1 and then descends into the panel but not through the interior surface 3 of the panel. As specified by an engineer, the channel 5 has a depth and a bottom of narrower width than at the exterior surface. In the preferred embodiment here shown, the channel has its width markedly narrowed at approximately one quarter of the depth. From that point downwards, the channel expands in width similar to a trapezoid. At the bottom of the channel, the width of the channel is less than that at the exterior surface 2. Contouring the channels aids in the erection of the formed concrete affixed thereon.

Figure 2A:
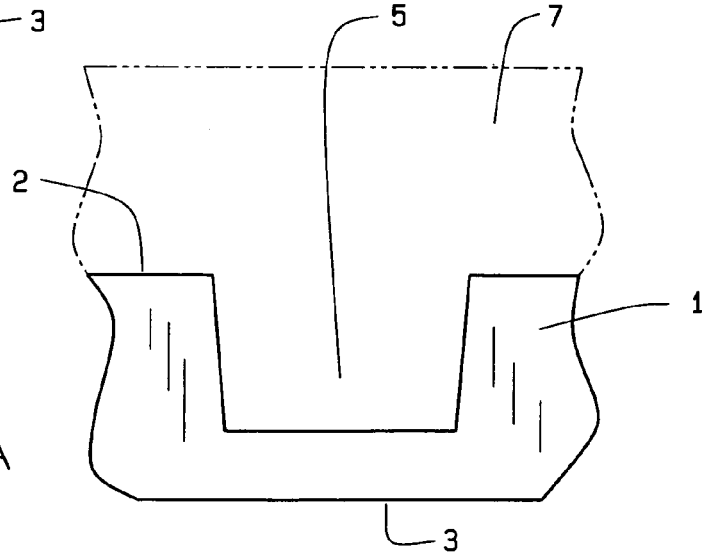
FIG. 2A shows a detailed view of an alternate channel in the present invention.

Alternatively the channel has a generally rectangular shape as shown in FIG. 2A. As before the channel depth meets ACI minimums and allows for reinforcing steel. The channel generally has a constant width through the depth of the channel. The constant width of the channel simplifies engineering of the panel and eases locating reinforcing steel and lifting inserts during assembly of a panel.

In use, the panel of the present invention is placed within a conventional forming frame, often called a crib frame generally four foot by eight foot, or the like. The forming frame may be engineered as specified so alternate dimensions of the forming frame are permissible. The forming frame retains concrete when applied in fluid form upon the exterior surface of the panel.

Figure 3:
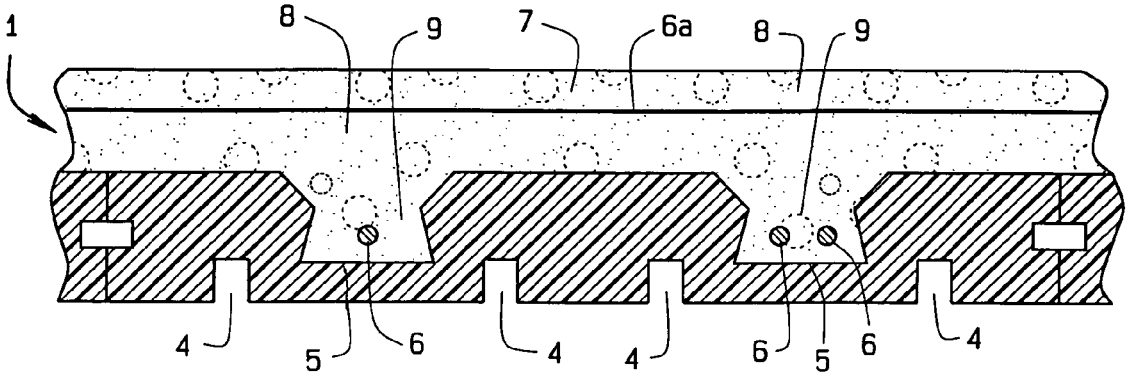
FIG. 3 describes a sectional view of concrete and reinforcing steel applied to the present invention.

As shown in FIG. 3, reinforcing steel or rebars 6 are placed within the channels 5 as shown on the construction plans and as specified by engineering for the project. In the event rebars or other material penetrates through the panel, plastic ties, such as those by Fabor, will be used. The plastic ties are also used to secure the rebars 6 to the panel 1 prior to concrete 7 placement. The plastic ties prevent transmission of thermal energy through the rebar into the panel 1 and then into a building. Transmission of heat or cold into a building by rebar is commonly called a short circuit.

Concrete is mixed using a ratio of six bags of cement or another engineered mixture if so specified. After placing the rebar 6, concrete 7 is placed upon the exterior surface 2 of the panel and within the entire forming frame. Then concrete 7 is placed to fill the channels 5 and then wire mesh 6*a* is located upon the exterior surface at the base of the concrete lift. Concrete is then placed on top of the mesh until the desired thickness is reached. Concrete is then screeded and vibrated to remove voids forming the section of panel 1 shown in FIG. 3. The concrete in FIG. 3 forms a slab upon the exterior surface 2 of the panel and tees 8 that have webs 9 extending into the channels 5. The webs 9 attain the shape of the channel 5, here trapezoidal. The shape of the channel 5 significantly retains the foam panel 1 of the webs and to the concrete whether the slab is positioned flat as a floor or raised upright into a wall.

Figure 4:
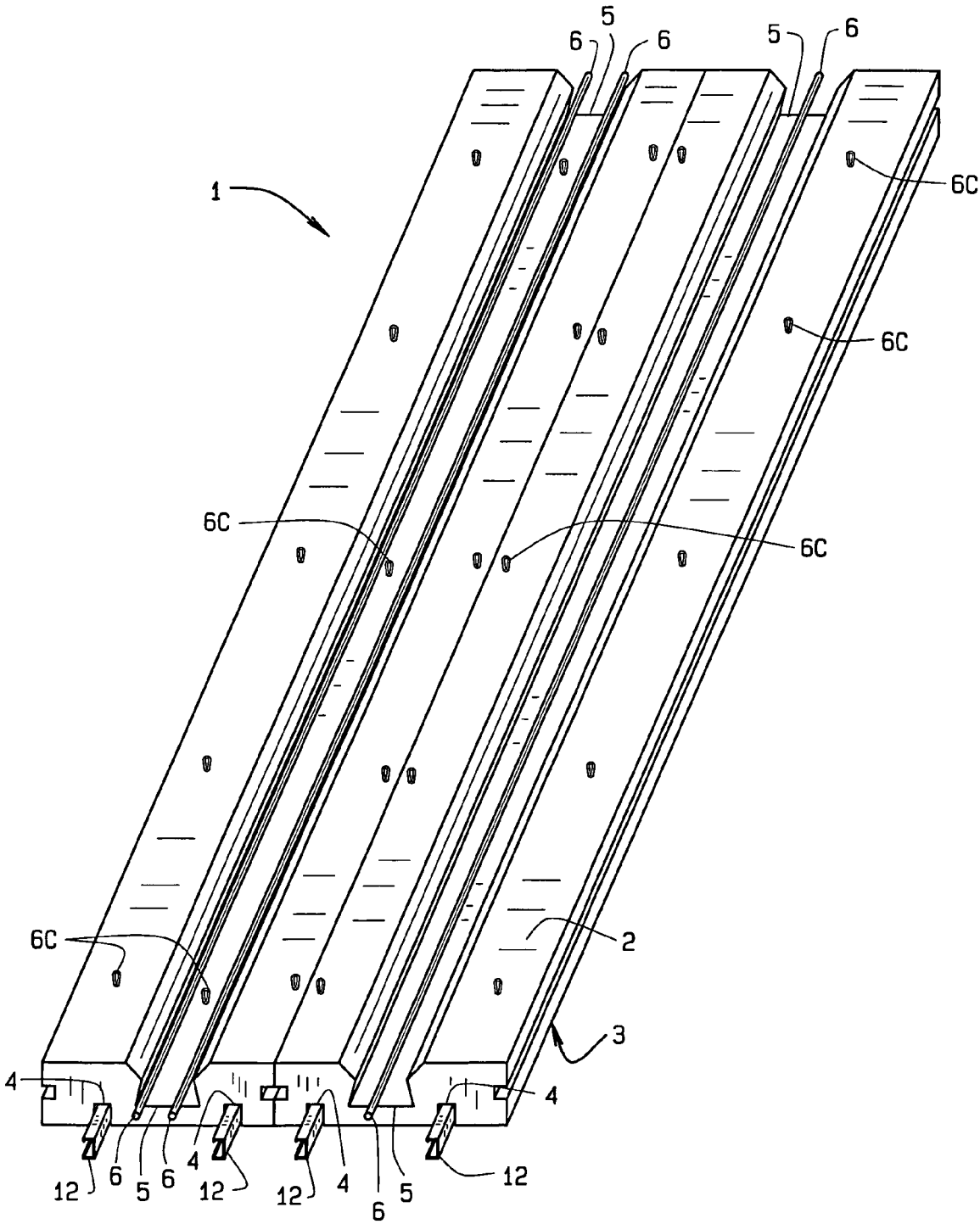
FIG. 4 shows an isometric view of reinforcing steel and furring strips applied to the present invention.

FIG. 4 then shows an alternate embodiment of the present invention using reinforcement to attain greater spans or lengths. The reinforcing members extend for the length of the panel 1, flank the channels 5, and occupy chases 4 molded into the panel 1 parallel to the channels. The preferred embodiment has two C shaped channel members 12 in the chases 4 and flanking each channel 5 with the flanges of the members 12 oriented away from the channel. In an alternate embodiment, the flanges of the members are oriented in the same direction for all members in the panel. Rebar 6 and chairs 6*c* are then placed upon the remainder of the panel 1 as per the specifications of the engineer.

Figure 5:
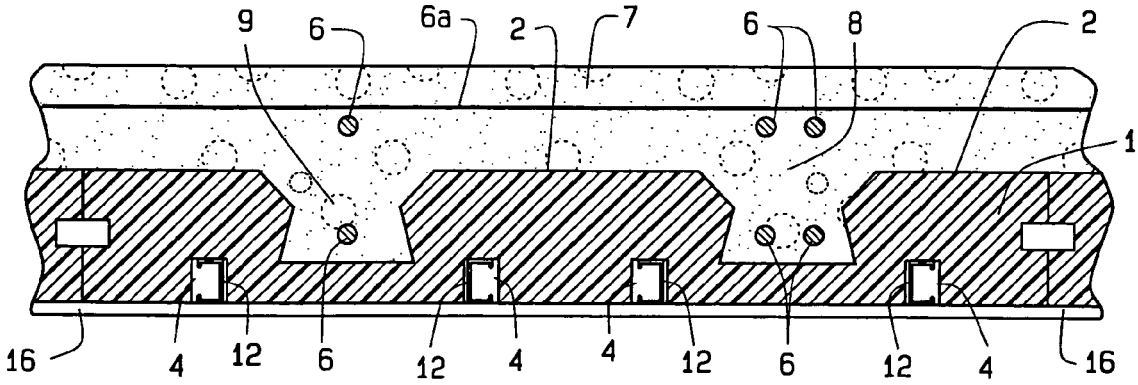
FIG. 5 describes a sectional view of concrete applied to the reinforcing steel of FIG. 4.

Similar to FIG. 3, FIG. 5 shows concrete placed upon the exterior surface 2 of the panel having reinforcement 6 shown in FIG. 4, and within the entire forming frame. The concrete is then screeded and vibrated to remove voids forming the section of panel shown in FIG. 5. The concrete in FIG. 5 forms a slab upon the exterior surface 2 of the panel and tees 8 that have webs 9 extending into the channels 5. The webs are reinforced with one or more rods 6 extending lengthwise pursuant to the engineer's structural reinforcing plan. The webs 9 attain the shape of the channel 5, here trapezoidal, which retains and backs the foam panel 1 upon the webs 9 snugly adjacent to the slab. The foam and concrete function as a unit whether the slab is positioned for use as decking or upright as a wall. In an alternate embodiment, the webs 9 may have a generally rectangular shape. The rectangular shape provides a constant width that eases design calculations and installation of structural reinforcement and lifting loops.

Figure 6:
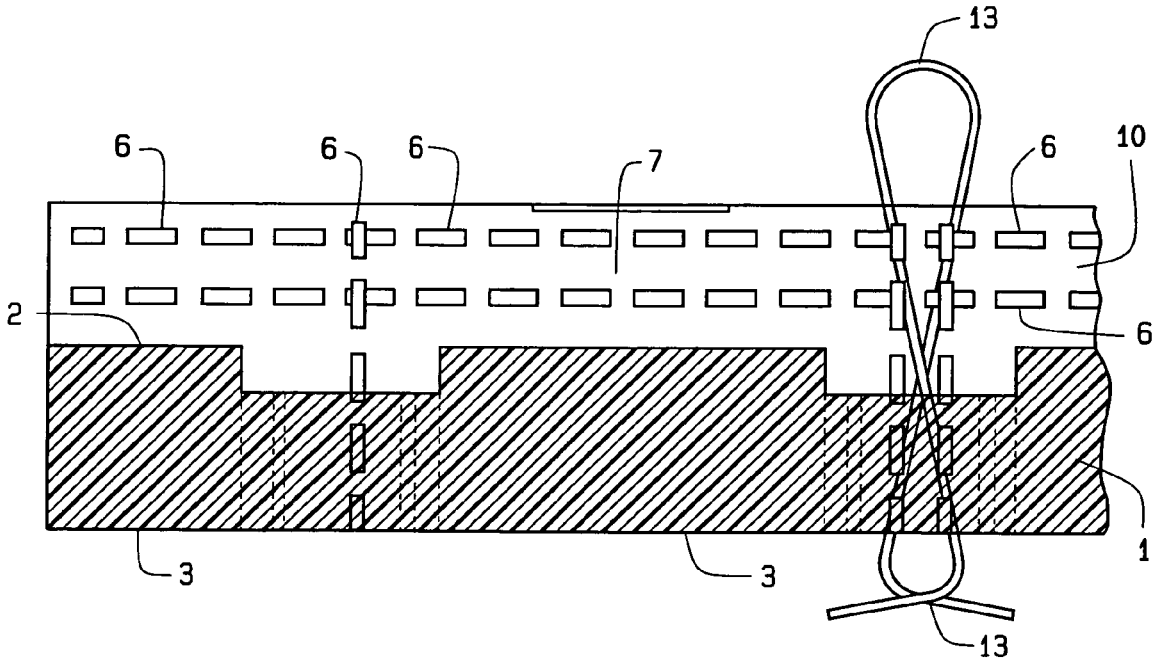
FIG. 6 describes a sectional view of a lifting loop embedded into the reinforcing steel of the present invention.

For flooring or walls, the concrete slabs with attached foam of the present invention will be moved upon a jobsite. In FIG. 6, the present invention has an alternative embodiment that includes a lifting loop 13 placed within the reinforcing steel 6, the concrete 7, and into a channel 5. The loop 13 extends out of the end of a channel 5 for a crane or other lifting device to grasp. Each slab has at least two loops 13 spaced apart and collinear to provide for balanced lifting of a panel 1 bearing concrete 7. The lifting loops may also be lifting inserts such as those provided by Burke or Dayton Superior. The preferred embodiment has a lifting loop formed with cable however, alternative forms of lifting include bars, clevises, and bolts located within the reinforcing steel and extending from the ends of channels.

Figure 7:
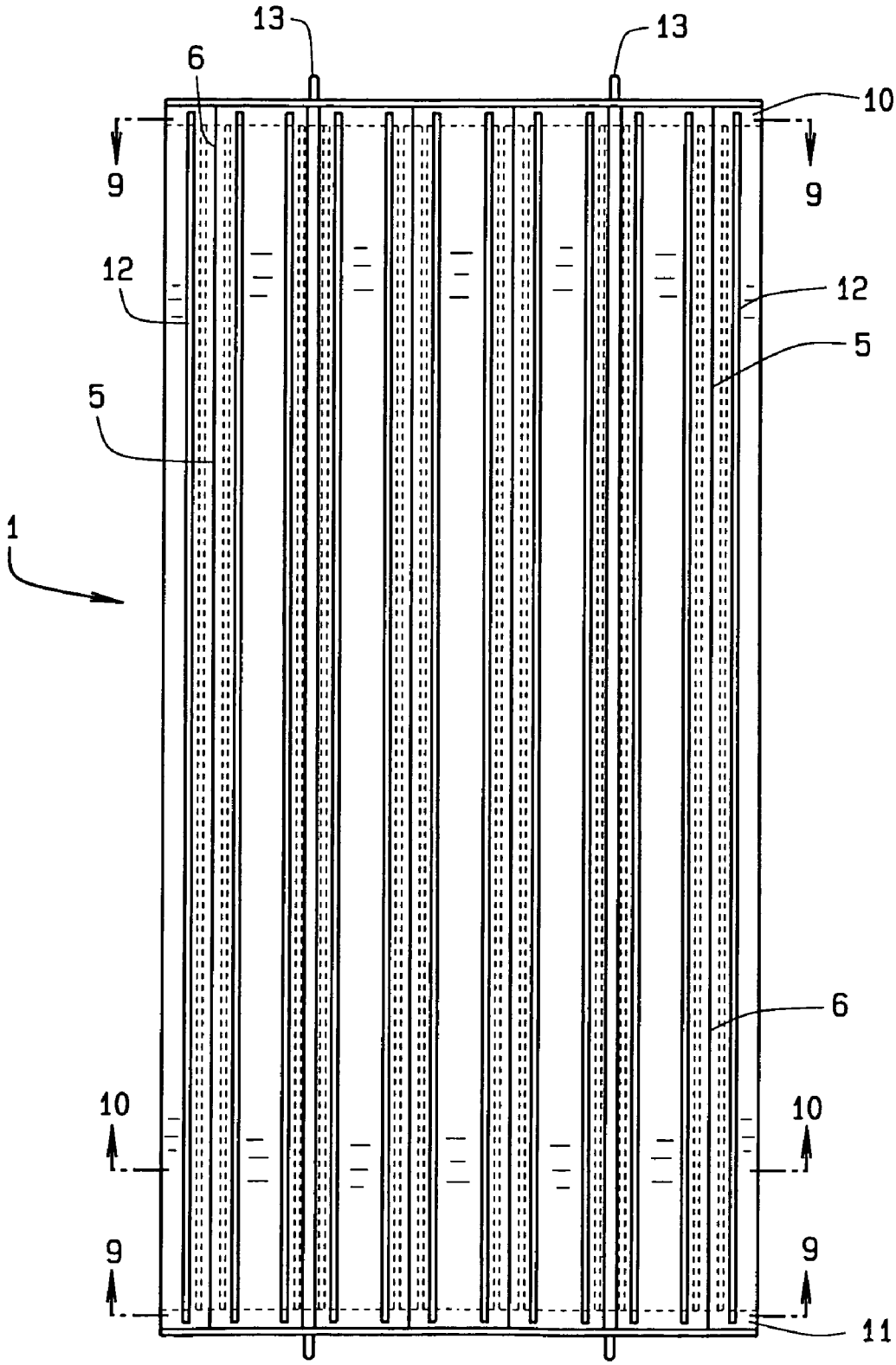
FIG. 7 shows a front view of the preferred embodiment of the present invention.

After removing the forming frame when the concrete hardens, a slab appears in FIG. 7. The slab has concrete upon the exterior surface and foam upon the interior surface 3. FIG. 7 shows the interior face, namely the foam, with channels and reinforcing steel shown in relief. The interior surface 3 is bounded at the top and the bottom by a header 10 and a footer 11 cast in concrete, and previously shown in FIG. 6. Towards one end, generally the top of a slab, two lifting loops 13 extend from the slab denoting an alternate embodiment. In an alternate embodiment, studs 12 are placed in the chases 4 to aid in installation of interior face material such as concrete, drywall, plaster, textile, fabric, or additional insulation. The steel studs 12 extend beyond the length of the foam panel 1 and into the header 10 and footer 11. Concrete in the header 10 and footer 11 secures the steel studs 12 within the present invention as later shown in FIG. 9.

Figure 8:
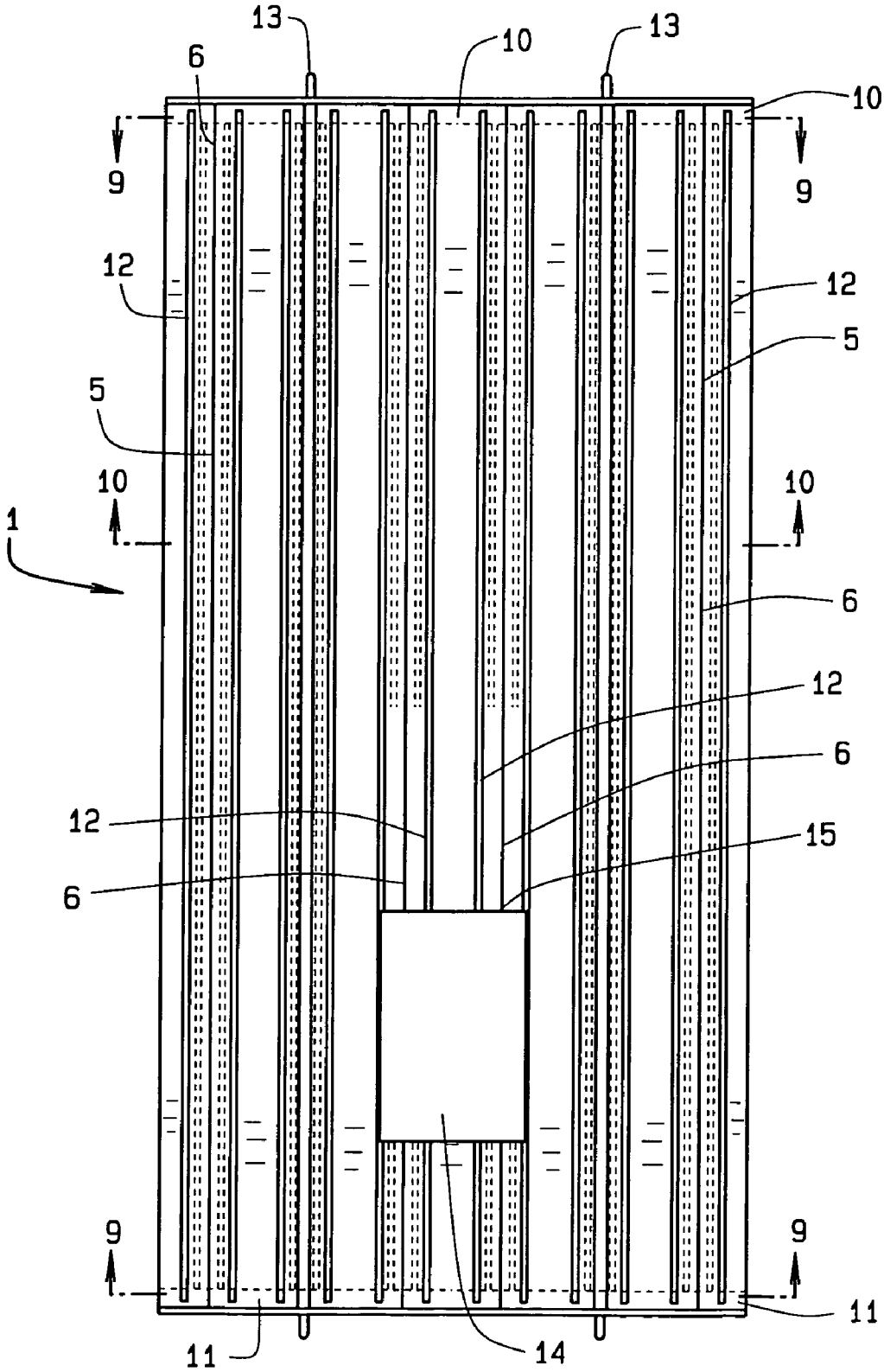
FIG. 8 shows a front view of an alternate embodiment of the present invention.

Then similar to FIG. 7, FIG. 8 shows a slab and panel with an opening 14 formed through the slab and the panel 1. The panel is cut to the desired dimensions of the opening 14 and additional reinforcing steel 15 is placed proximate to the opening. Generally the opening has a thickened concrete edge upon its perimeter. More particularly, rebar or other framing is placed above and below the opening to transfer the deadload of the slab around the opening 14 to the base of the slab or footer 11. This alternate embodiment has lifting loops 13 upon the top end or header 10 opposite the opening. In an alternate embodiment, steel studs 12 are again placed in the chases 4 to aid installation upon the interior surface 3 of material such as drywall, plaster, fabric, textile, concrete, or additional insulation. The steel studs 12 extend beyond the length of the foam panel 1 and into the header 10 and footer 11. However, the steel studs 12 are shortened where they intersect the framing of the opening 14. The steel studs are secured to the framing with welding, clips or other conventional methods. In the vicinity of the opening 14, the shortened steel studs are secured to the thickened concrete of the perimeter of the opening. Concrete 7 in the header 10 and footer 11 secures the remaining steel studs 12 within the present invention.

The contractor performing installation retains the option to add a vapor barrier to the interior surface 3 of the present invention. The vapor barrier, generally a plastic sheet, attaches to studs 12 placed into the chases 4. The contractor attaches the vapor barrier to the studs using conventional methods.

Figure 9:
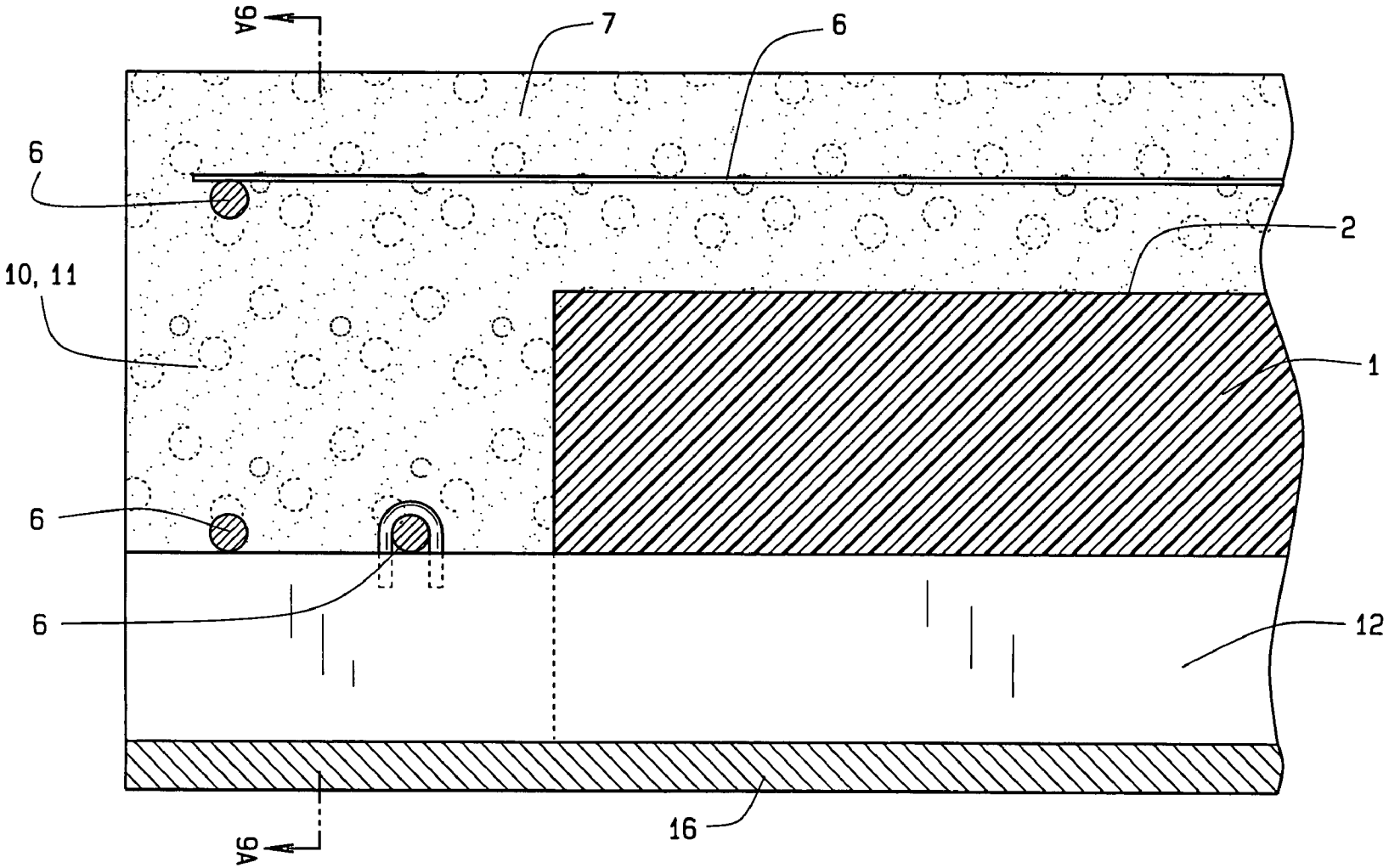
FIG. 9 shows a detailed view of a furring strip, or a stud reinforcement connecting to the bond beam of the header or the footer.

In a still further alternate embodiment, the interior surface 16, here shown in FIG. 9, of the present invention is concrete 7. FIG. 9 shows the studs 12, as shown in FIG. 4, extending beyond the panel, now extending into the header 10 or footer 11 where the studs are tied into the reinforcing steel 6. This alternate embodiment adds an additional step to the construction of the present invention while using the same foam panel. A first lift of concrete 7 is placed in the form to later become the interior surface 16. As previously shown in FIG. 5 where the studs 12 occupy chases 4 slightly outside the inner surface 16. Then the foam panel 1 is positioned upon the interior surface 16. The rest of the invention is then constructed as previously described. When the concrete cures and the forms are removed, the alternate embodiment appears as a foam panel 1 with an interior surface 16 of concrete of the required depth in the specification and construction plans, approximately four inches thick, and an exterior face 2 of concrete structurally reinforced to bear wind and roof loads transmitted to the present invention.

Figure 9A:
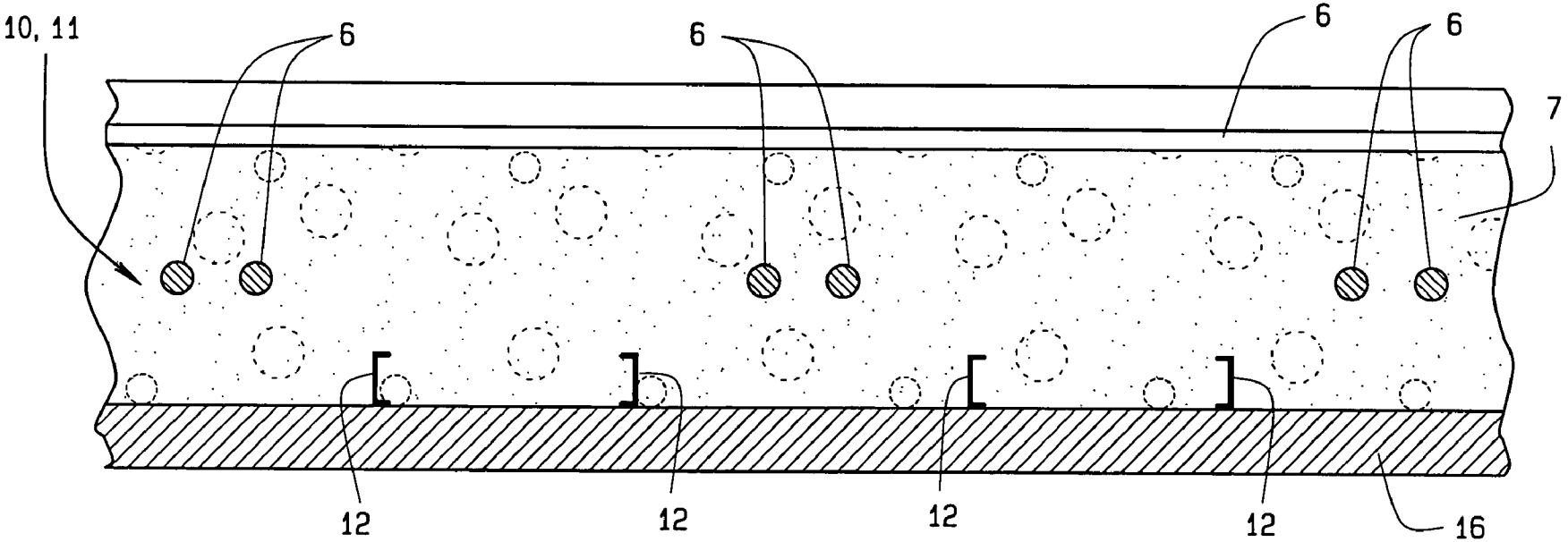
FIG. 9A shows a section view of furring strips or stud reinforcement embedded in the header or the footer of the present invention.

And, FIG. 9A shows the studs 12 embedded in either the header 10 or footer 11 beyond the ends of the panel 1. The studs 12 are tied to the reinforcing steel for structural integrity, as previously shown in FIG. 9. As the studs 12 extend beyond the foam panel 1, the studs are encapsulated or surrounded by concrete 7 and the inner surface 16 thus making a strong bond. Encapsulated in the header and the footer, the studs provide a secure mount for an inner surface 16 later applied along the length of the studs.

Figure 10:
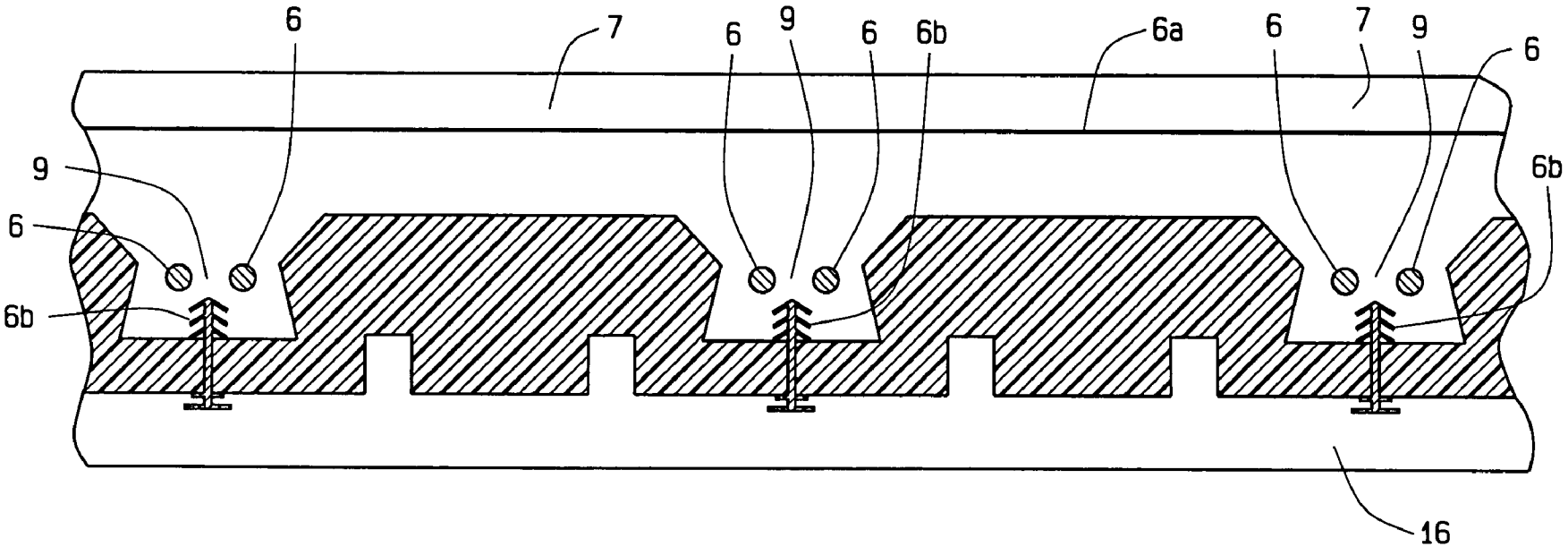

The still further alternate embodiment is shown with more detail in FIG. 10 where the concrete of the interior surface 16 bonds to the panel 1. To strengthen the bond, the panel has a plurality of nails **6*b* inserted through the interior surface 3 of a panel and into the webs 9. The nails 6*b* have a double head with the second head abutting the panel 1. The double head is generally round and has the first head and the second head mutually spaced apart, concentric, and parallel. The second head has a smaller diameter than the first head. The double head is centered upon a shaft that extends into the panel. The shaft ends in at least one barb. A barb eases insertion of the nail into the panel 1 and then engages and grips the concrete of a web 9**. Preferably, the nail has at least three barbs extending at an angle from the shaft forming an appearance similar to an arrowhead.

In use of the still further alternate embodiment, the nails are inserted into the panel generally before pouring concrete. As previously described, a first lift of concrete is placed for the interior surface 16. Before the concrete sets, the panel with the interior face 3 and the nails **6*b* down is placed upon the first lift of concrete or inner surface 16 where the first head of each nail then embeds. The rest of the invention is then constructed as previously described. When the concrete 7 cures, the nails 6*b* are secured into the webs 9 at the barbs and into the inner surface 16 at the double head. The panel 1 is held fast between the webs 9 and the inner surface 16 by the nails 6*b*. The nails mechanically secure the inner surface 16 and panel 1 to the webs 9 which augment the chemical and interstitial bonds of the concrete 7 and the inner surface 16** to the panel.

This invention, as disclosed, provides a precast panel for commercial and industrial applications, or other buildings, and both for load and non-load bearing walls. A panel preferably will be assembled at the job site with foam panels 1 placed within forming frames. Its system for manufacture is basically performed in three stages, initially, the panel of polystyrene is sculpted to create the engineered, dimensional channels 5 vertically within the panel 1, wherein the steel reinforcement 6 is required.

The finished panels 1 then include the side slots or keyways, which may be either precut into the polystyrene, or cut after the panels are formed. The panels are designed, in the preferred embodiment, as approximately thirty two (32) inches in width and a length as desired and previously shown in FIG. 3. Other widths can be formed. The panels are suitable for use in a wall or as floor decking but less so as a roof. Several panels can be joined together with keys arranged in a pattern along the length of adjacent panels, or have the concrete poured therein after the panels are joined together, in order to form a "mega" type of panel. These panels could be assembled up to multiple feet in height and width, as much as forty feet or more, as may be required. The present designs for wall forms, of the current invention, while normally being a thirty two inch width, also include the fabrication of panels of greater width, or to other desired or required dimensions.

The industrial panels of this invention may be designed as either load or non-load bearing structural wall systems, as in the commercial panel wall, as such may be required. In the commercial wall panel, it is preferable that the header 10 and footer 11 of a slab lap around and contain the foam panel 1. Concrete can surround the outer formed panel, for further structural reinforcement. The header 10 and footer 11 are reinforced with steel 6 at engineered locations and diameters. The header receives vertical loads, the panel bears the loads, and the footer transmits the loads to the foundation.

Reinforcing steel or rods 6, as normally used within concrete panels, will have been previously located at the engineered locations within the intended reinforcement areas that is within the sculpted channels, to add further structural strength to the skeletal concrete reinforcing tees 8, provided within the wall panel 1. The use of drywall or lightweight concrete, applied to the interior surface 16 of the sculpted polystyrene slab, provides greater durability than the use of a polystyrene sheet, it adds greater fire resistance, and enhances chemical resistance, particularly where these become priority issues in the design and fabrication of an industrial building, and also as required to meet code.

Figure 11A:
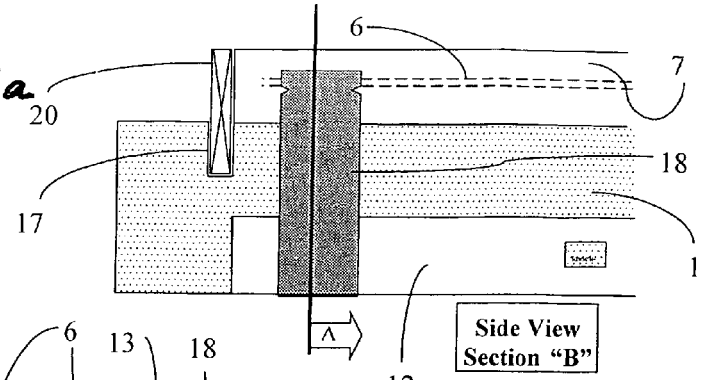
FIG. 11A provides a side view thereof.
Figure 11:
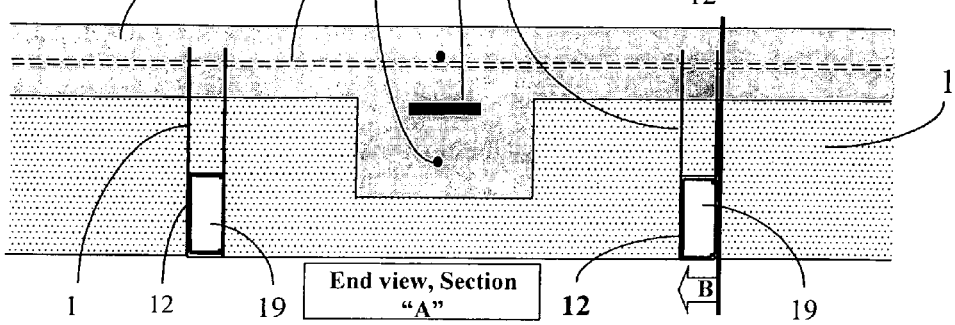
FIG. 11 provides a modified sectional view of the concrete as applied to the reinforcing steel and upon the polymer foam.

FIGS. 11 and 11A show a modification to the formed panels, with a concrete 7 applied over the polymer foam or layer of insulation 1. The reinforcing steel 6 is embedded within the concrete. The forms 17 cooperate with the insulation to form the concrete as poured. The metal tie 18 provides a connection between the reinforcing steel 6 and the foam and concrete, extending down to the steel studs 12.

Figure 12A:
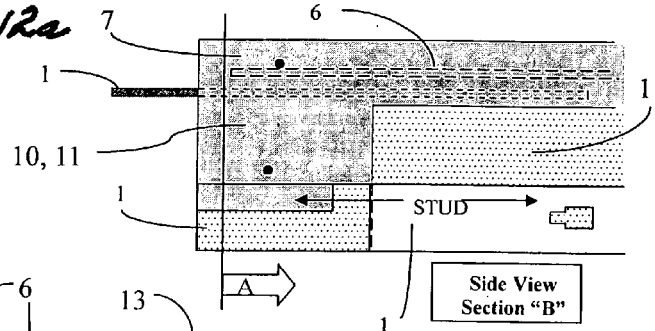
FIG. 12A is a side view thereof.
Figure 12:
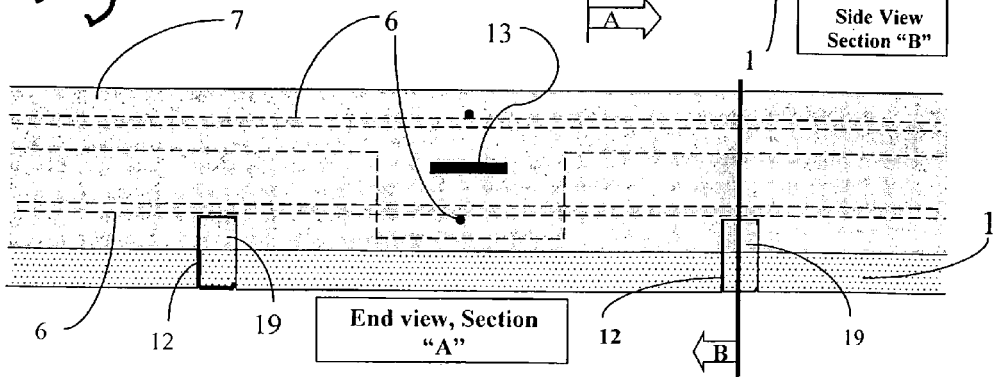
FIG. 12 is an end view of modification to concrete applied to the polymer foam panel.

FIGS. 12 and 12A show similar construction for a modified panel.

Figure 13:
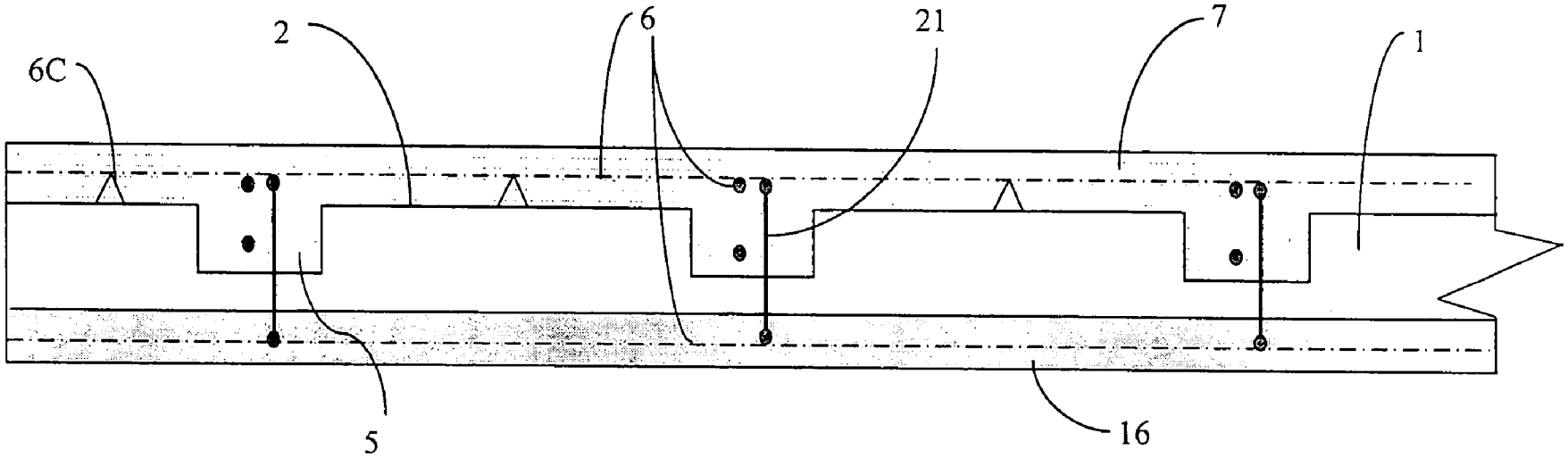
FIG. 13 is an end view of the concrete as applied to the polymer foam in forming a modified panel.

FIG. 13 discloses the use of a connecting ties 21 that extend between the reinforcing rods provided both within the upper concrete portion of the panel, and the reinforcing rods maintained in the bottom concrete panel. Thus, insulation material is provided intermediate thereof.

From the aforementioned description, a multiple layer polymer foam concrete forming system has been described. The system is uniquely capable of shaping concrete webs to retain a foam panel following curing of the concrete. The system and its various components may be manufactured from many materials, including but not limited to, singly or in combination, polymers, polystyrene, polyethylene, polypropylene, polyvinyl chloride, nylon, ferrous and non-ferrous metals and their alloys, and composites, all for forming a laminate concrete foam wall.

We claim:

1. An insulated concrete wall panel section useful for tilt up contraction, comprising:

a foam panel generally rectangular in shape having a length substantially greater than its width, an exterior surface, an opposite interior surface, a plurality of chases in said interior surface parallel to the length of said panel, and a plurality of channels in said exterior surface parallel to the length of said panel;

an outer concrete layer placed upon said exterior surface and onto said channels each forming a tee having an upright web, said concrete extending beyond said panel forming a header and an opposite footer across the width of said panel;

reinforcement located within and proximate to said channel and to said exterior surface, said reinforcement extending into said header and footer;

whereby said concrete attains a certain thickness upon said exterior surface, and said panel and said concrete attains a combined thickness;

said chases having an approximate rectangular shape in cross section, and said channels having an approximate rectangular shape in cross section and of greater width than said chases;

a stud located within each of said chases, and also extending into said header and said footer;

said reinforcement having at least one connecting means extending outwardly from said header to facilitate lifting of said wall panel;

an inner concrete layer placed upon and applied to said interior surface of said panel, generally prior to placement of concrete upon the exterior surface of said foam panel;

the outer and interior layers of concrete are continuous through the header and the footer of said wall panel and integrated with said interior reinforcements and said studs to create a continuous reinforced concrete bond between the inside and outside concrete layers in developing a structural composite having foam insulation located intermediately thereof; and thereby forming a fully reinforced foam panel insulated concrete wall panel section that is capable of being formed and tilted up in situ at the location of usage of the wall panel in a building structure.

2. The insulated concrete wall panel of claim 1 further comprising:

said channels having a generally contoured cross section with the wider base of the cross section towards said interior face formed in said channel thereby locking said panel onto said concrete.

3. The insulated concrete wall panel of claim 2 wherein said contoured channel is of a trapezoidal shape.

4. The insulated concrete wall panel of claim 2 wherein said channel has a contoured cross section with a wider base of the cross section towards the interior face of said tee formed in said channel.

5. The insulated concrete wall panel of claim 2 wherein said channel has a rectangular cross section.

6. The insulated concrete wall panel of claim 1 further comprising:

said panel having at least one opening allowing communication through said exterior surface and said interior surface; and, said reinforcement having framing proximate said opening and towards said header, said framing transferring loads borne by said tees intersected by said opening.

7. The insulated concrete wall panel of claim 1 wherein outer layer of drywall, insulation, paneling, sheeting, plaster, additional concrete, textile or fabric affixed to the concrete layer positioned upon the interior surface of the formed panel.

8. The insulated concrete wall panel of claim 1 and further comprising: said exterior surface having a groove along the perimeter edge for insertion of an integrated edge form.

9. The insulated concrete wall panel of claim 1 and further comprising: at least one metal tie securing within the exterior concrete and allowing movement for expansion and contraction.

10. The insulated concrete wall panel of claim 9 wherein said studs are provided within the foam panel, and embedded within the concrete to provide for adjustments in the panel design during usage.

11. The insulated concrete wall panel of claim 1 and further comprising: said chase within the interior face being designed to retain electrical or plumbing conduits within the area of said chase.

12. The insulated concrete wall panel of claim 1 and including a series of nails extending through the foam panel and provided for affixing to the concrete layer positioned upon said interior surface of said panel, and for affixing to the concrete placed upon the exterior surface of the foam panel and where it extends into the said channels.

13. The insulated concrete wall panel of claim 1 and including connecting ties securing between the studs and reinforcement.

* * * * *